US007229074B2

(12) United States Patent
Daines

(10) Patent No.: US 7,229,074 B2
(45) Date of Patent: Jun. 12, 2007

(54) BLACKJACK WITH A HEDGE BET

(75) Inventor: Shirley Daines, Red Deer (CA)

(73) Assignee: Canadian 21 Stook Ltd., Red Deer, Alberta (CA)

( * ) Notice: Subject to any disclaimer, the term of this patent is extended or adjusted under 35 U.S.C. 154(b) by 238 days.

(21) Appl. No.: 10/905,207

(22) Filed: Dec. 21, 2004

(65) Prior Publication Data

US 2006/0131808 A1 Jun. 22, 2006

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 4,861,041 A * 8/1989 Jones et al. ..... 273/292
4,948,134 A * 8/1990 Suttle et al. ..... 463/13
5,022,653 A * 6/1991 Suttle et al. ..... 463/13
5,174,579 A * 12/1992 Griffiths ..... 273/292
5,275,416 A * 1/1994 Schorr et al. ..... 273/292
5,374,067 A * 12/1994 Jones ..... 273/292
5,377,973 A * 1/1995 Jones et al. ..... 463/12
5,454,570 A * 10/1995 Karal ..... 273/292
5,816,575 A * 10/1998 Keller ..... 273/292
5,845,907 A * 12/1998 Wells ..... 273/292
6,131,908 A * 10/2000 Palmer ..... 273/292
6,379,245 B2 * 4/2002 De Keller ..... 463/13
2005/0227756 A1 * 10/2005 Kane et al. ..... 463/25
2006/0157935 A1 * 7/2006 Grigsby ..... 273/292

OTHER PUBLICATIONS

Virginia L. graham, C. Ionescu Tulcea—A Book On Casino Gambling, 1978, Pocket Books pp. 72-74.*

* cited by examiner

*Primary Examiner*—Eugene Kim
*Assistant Examiner*—Dolores R. Collins
(74) *Attorney, Agent, or Firm*—Bennett Jones LLP

(57) ABSTRACT

A blackjack card game method includes an optional hedge bet to the player, wherein the player may win the hedge bet if the dealer has a card count of 19 or better, or the player may lose the hedge bet if the dealer has a card count of 18 or less or busts.

4 Claims, No Drawings

BLACKJACK WITH A HEDGE BET

BACKGROUND OF THE INVENTION

This invention relates to a method of playing a card game based on the well-known game of "21" or blackjack.

SUMMARY OF THE INVENTION

In one embodiment, the invention may comprise a method of playing blackjack between a dealer and at least one player using at least one standard deck of cards, comprising the steps of:

(a) allowing the player to place a hedge bet if the player has also placed a blackjack bet;
(b) dealing cards to each of the dealer and the player or players in accordance with a blackjack game;
(c) collecting or paying any blackjack bets in accordance with the blackjack game;
(d) collecting or paying any hedge bets, regardless of the outcome of the blackjack bet, wherein the player wins if the dealer has a card count of 19 or better and the player loses if the dealer has a card count of 18 or worse or busts.

DETAILED DESCRIPTION OF PREFERRED EMBODIMENT

When describing the present invention, all terms not defined herein have their common art-recognized meanings. The term "live casino game" is intended to encompass a game in which the house acts as the banker, the house collecting all losing wagers and paying all winning wagers. The term "wager" is used synonymously with the term "bet". The dealer is employed by the house and each player plays exclusively against the house.

The method of the present invention is intended to be practiced as a live casino game in a casino or gaming house environment where players may wager against the house, but may not be restricted to such an environment. In a conventional game of blackjack or 21, the basic object of the game is to achieve a hand of cards close to or equal to 21 without exceeding 21. If a hand exceeds 21, the player or dealer is said to have "bust". The card game method of the present invention may be played with a standard deck of 52 cards, and is preferably played with at least three decks, and is more preferably played with six or more decks of cards. As is conventionally the case, numerical cards are valued at their face value, face cards count as 10 and aces count as 1 or 11 points.

In one embodiment, the dealer plays against each player as in conventional blackjack. The players each play their hands out, and then the dealer plays his hand against all the players. Play begins with each player making a conventional blackjack bet. If the player has done so, then the player may also place a hedge bet, prior to any cards being dealt.

The hedge bet is an optional betting method which is intended to allow the player to win a bet if the dealer has a good card count, or lose the hedge bet if the dealer has a poor card count. The outcome of the hedge bet is not dependent on the outcome of the main blackjack bet. A player may win the blackjack bet and the hedge bet, or alternatively lose both the blackjack bet and the hedge bet. Even so, it does provide a hedge against losing the blackjack bet. For example, in one embodiment, the player may win 3 to 1 on his hedge bet if the dealer gets blackjack.

In a preferred embodiment, the payouts for various dealer card counts are shown in Table 1 and provide approximately a 2.5%-2.8% house edge using multiple decks of cards.

TABLE 1

| Dealers Final Card Count | Payout |
|---|---|
| Blackjack | 3 to 1 |
| 19, 20, 21 | 1 to 1 |
| 18, 17, Dealer Busts | Player Loses |

The magnitude of the house edge depends on whether or not the house rules allow a dealer to stand on a soft 17 or which require the dealer hit on a soft 17. If the dealer stands on a soft 17, the house edge may increase to about 3.8%.

As is apparent to one skilled in the art, the methods disclosed herein may be implemented at a live table game or electronically in an electronic video type gaming device, of the same general type disclosed in U.S. Pat. Nos. 4,948,134; 5,022,653; 5,377,973; 5,374,067; and 5,382,025. In the electronic version, the hand(s) of the player(s) and dealer take the form of video representations of playing cards displayed on a screen, under the invention claimed herein.

What is claimed is:

1. A method of playing blackjack between a dealer and at least one player using at least one standard deck of cards, comprising the steps of:

(a) allowing the player to place a hedge bet if the player has also placed a blackjack bet;
(b) dealing cards to each of the dealer and the player or players in accordance with a blackjack game;
(c) collecting or paying any blackjack bets in accordance with the blackjack game;
(d) collecting or paying any hedge bets, regardless of the outcome of the blackjack bet, wherein the player wins if the dealer has a card count of 19 or better and the player loses if the dealer has a card count of 18 or worse or busts.

2. The method of claim 1 wherein the player wins 3 to 1 if the dealer has blackjack.

3. The method of claim 2 wherein the player wins 1 to 1 if the dealer has a card count of 19, 20 or 21.

4. The method of claim 1 wherein the player loses the hedge bet if the dealer busts or has a card count of 17 or 18, and the player wins the hedge bet if the dealer has a card count of 19 or better.

* * * * *